US006808418B2

(12) United States Patent
Horner

(10) Patent No.: US 6,808,418 B2
(45) Date of Patent: Oct. 26, 2004

(54) DUMMY PLUG FOR WIRING HARNESS

(75) Inventor: Patrick L. Horner, Cuyahoga Falls, OH (US)

(73) Assignee: Quality Synthetic Rubber, Inc., Twinsburg, OH (US)

( * ) Notice: Subject to any disclaimer, the term of this patent is extended or adjusted under 35 U.S.C. 154(b) by 0 days.

(21) Appl. No.: 09/735,006

(22) Filed: Dec. 12, 2000

(65) Prior Publication Data

US 2001/0007802 A1 Jul. 12, 2001

Related U.S. Application Data

(63) Continuation-in-part of application No. 09/429,443, filed on Oct. 28, 1999, now abandoned.

(51) Int. Cl.[7] ..... H01R 13/14
(52) U.S. Cl. ..... 439/587
(58) Field of Search ..... 439/587, 148

(56) References Cited

U.S. PATENT DOCUMENTS

| | | | | |
|---|---|---|---|---|
| 4,521,064 A | * | 6/1985 | Knapp et al. | 439/45 M |
| 4,681,691 A | * | 7/1987 | Schriver, Jr. | 252/12 |
| 4,886,471 A | | 12/1989 | Fleshman, Jr. | 439/192 |
| 4,993,964 A | | 2/1991 | Trummer | 439/272 |
| 5,393,242 A | | 2/1995 | VanDerStuyf | 439/364 |
| 5,482,479 A | | 1/1996 | Hayashi et al. | 295/460 |
| 5,551,892 A | | 9/1996 | Endo et al. | 439/587 |
| 5,562,494 A | | 10/1996 | Fujiwara | 439/587 |
| 5,997,320 A | * | 12/1999 | DeMello | 439/148 |
| 6,039,685 A | | 3/2000 | Bushek | 600/25 |

FOREIGN PATENT DOCUMENTS

JP 374482 3/1991

* cited by examiner

*Primary Examiner*—P. Austin Bradley
*Assistant Examiner*—Phuongchi Nguyen
(74) *Attorney, Agent, or Firm*—Brouse McDowell; Roger D. Emerson; Daniel A. Thomson

(57) ABSTRACT

A dummy plug for wiring harnesses is disclosed. The dummy plug is used in an unused connector cavity of the wiring harness, thereby electrically isolating the connector cavity in the wiring harness to prevent short circuits. The dummy plug is substantially flush with the latch arm of the wiring harness, so that a pogo pin can determine whether or not the connector cavity is in use. The dummy plug has a design such that pressure blowout is prevented. A method for plugging an unused connector cavity is also disclosed, the method including the steps of providing a dummy plug having a head, a stem, and a female end, providing a wiring harness having at least one connector cavity and at least one latch arm and inserting the dummy plug into the unused connector cavity so that the female end is substantially flush with the latch arm.

5 Claims, 12 Drawing Sheets

DUMMY PLUG FOR WIRING HARNESS

This application is a continuation-in-part application of U.S. Ser. No. 09/429,443, filed Oct. 28, 1999 now abandoned. This invention pertains to the art of wiring harnesses and connectors, and more particularly to dummy plugs used in unused connector cavities.

BACKGROUND OF THE INVENTION

A. Field of Invention

B. Description of the Related Art

The electrical systems of motor vehicles of all types are becoming increasingly complex. Generally, motor vehicles are provided with one or more wiring harnesses, each of which is a prefabricated bundle of wires having appropriate terminals for interconnection of the appropriate electrical components and systems of the vehicle. Often, a wiring harness, or a portion thereof, must pass through a vehicle bulkhead, including firewalls, acoustical barriers or panels, pressure resistant walls and the like. It has been found most advantageous to utilize multiple terminal connectors to convey a number of electrical terminal connectors through such bulkheads. Additionally, multiple terminal connectors are employed in other situations, both vehicular and non-vehicular, where very large numbers of electrical terminals must be reversibly interconnected.

It is necessary that any multiple terminal electrical connector provide for the rapid, accurate, reversible and reliable interconnection of the appropriate wire pairs. Most multiple terminal connectors comprise a pair of mutable base members, each having one or more of the appropriate terminals retained therein. The base members maintain the terminals in the appropriate orientation and allow for ready connection and disconnection thereof. In most vehicular applications, it is further desirable that the connectors provide for environmentally sealed interconnection of the terminals so as to prevent failures due to moisture or corrosion. It is additionally desirable that the connectors be immune to loosening from vibration or other physical impact.

A connector having a housing adapted to receive a terminal fixture of a wiring harness of an automobile or the like is known. A terminal cavity for the reception of the terminal fixture is formed in the connector housing with the tow ends of the terminal cavity constituting an insertion-side opening through which a terminal fixture is inserted and a connection-side opening with the tip thereof facing the connection-side opening. Afterwards, the terminal fixture within this terminal cavity and the terminal fixture of the mating connector are connected via the connection-side opening. Because such a connector is a general-use part for forming various electrical circuits, i.e. is configured depending on the circuit in which it is employed, terminal fixtures may not be inserted into all of the terminal cavities. That is, some of the terminal cavities may be left vacant. A dummy plug made of rubber and having an outer diameter similar to that of a rubber seal is commonly inserted as a water-resistant measure for such vacant cavities.

Of course, whether a vacant terminal cavity like that described above will be left in the connector can be ascertained in the circuit design stage. Therefore, it is possible to forego this route and instead manufacture specialized connector housings of different specifications by means of differing molds so that excess terminal cavities to be left vacant are not formed. However, such a change in specifications involves a change in the basic structure of the mold. This creates an increase in cost because a completely different mold must be manufactured. This increase in cost is often prohibitive. For reasons such as this, the combination of a general-use connector with dummy plugs has become commonplace in the art.

It is necessary to detect whether or not dummy plugs are already stuffed in empty terminal cavities because there should be no cavities remaining unplugged. However, it is difficult to detect it from the outside due to the fact that each of the dummy plugs is not inserted deeply inside the individual terminal accommodating cavities and are therefore not detectable. In order to complete the detection thereof, there has been provided a device, in which a connector is settled in the main body of the device which is capable of airtightly keeping the interior ambient and provided with pressurized air therein, whereby the existence of stuffed dummy plugs is detected by a change of the inner air pressure. The device as constructed above, is rather costly and requires precision machinery components.

Apart from the above device, a connector terminal detecting tool has been provided. The connector terminal detecting tool can be adapted even for a connector provided with a spacer. The spacer is used in a terminal double-locking operation and is normally disposed at a side surface or back surface of the housing. The tool detects whether or not empty cavities are stuffed by dummy plugs by bringing a contact switch or a detection pin of the connector terminal detecting tool into contact with the dummy plug and checking the result. However, the reliability of this type of detection is not sufficient due to the above difference of the locations of the individual inserted dummy plugs.

The present invention has been made to solve the above-mentioned problems, and accordingly, it is an object of the present invention to provide a dummy plug, whereby it is easily and securely detected whether or not the dummy plugs are stuffed in the terminal cavities presently not in use.

It is well known that dummy plugs have been used to fill unused connector cavities. However, the current dummy plugs are made of rubber and are prone to pressure blowout. Pressure blowout refers to the process where a dummy plug is displaced out of the connector cavity by the action of mating the connectors. Such action compresses the air and, as the pressure rises, eventually causes the air to pop the dummy plug out of the connector cavity. Sometimes this event occurs when another member, such as a connector terminal detecting tool, is inserted the other distal end of the connector cavity.

One known type of dummy plug is disclosed in U.S. Pat. No. 4,993,964 to Trummer. Trummer discloses a plastic plug for use with an electrical connector which precludes the necessity for installation of separate end-seal plugs to effect sealing of any non-used pin contact cavities in the connector. However, the plastic plug used in Trummer does not extend to a latch arm of the connector. Since the plug in Trummer does not extend to the latch arm of the connector, the dummy plug cannot be detected by a pogo pin.

Another known type of dummy plug is disclosed in U.S. Pat. No. 5,551,892 to Endo et al. However, in Endo, the same problem as in the Trummer patent exists. The dummy plug disclosed in Endo is susceptible to the pressure blowout that the current invention is designed to prevent.

Another similar device is disclosed in U.S. Pat. No. 5,562,494 to Fujiwara. Fujiwara discloses a watertight plug comprising a main body having circular ribs on its outside surface and a wire insertion section having a cylindrical section into which a wire is inserted. The Fujiwara invention is used for encasing a wire to create a watertight seal, whereas the current invention is a dummy plug for use in an unused connector cavity.

Another known type of dummy plug is produced by Micro Plastics. However, the Micro Plastics dummy plug is designed for a non-sealed connector system in order to dampen vibration. The Micro Plastics dummy plug, while effective for its designed purpose, does not perform any sealing function.

Difficulties inherent in the related art are therefore overcome in a way that is simple and efficient while providing better and more advantageous results.

SUMMARY OF THE INVENTION

In accordance with one aspect of the current invention, a dummy plug for use with an associated wiring harness, the wiring harness having a connector body, two connector cavities, a flange for securing the dummy plug in place, the flange having a top surface and a bottom surface, a latch beam, two latch arms, a first length, a spacer, a perimeter seal, the perimeter seal having two latch arm openings for receiving the latch arms, the dummy plug comprising at least 18 durometer inherently lubricating silicon, a head, multiple ribs, the multiple ribs having a first width, a stem, the stem having a second width, the second width being less than the first width, a female end, the female end having a third width, the third width being less than the first width and greater than the second width, the female end having a base, the base being held in place by the associated bottom surface, and the dummy plug having a second length, the second length being substantially the same as the associated first length, such that the female end is substantially flush with the associated latch arm.

In accordance with still another aspect of the present invention, the dummy plug includes a first end, a second end and a second length, the second length being substantially the same as the first length of the associated wiring harness.

In accordance with another aspect of the present invention, a method for plugging an unused connector cavity includes the steps of providing a dummy plug having a head, a stem, and a female end, providing a wiring harness having at least one connector cavity, and at least one latch arm, and inserting the dummy plug into the unused connector cavity so that the female end is substantially flush with the at least one latch arm.

In accordance with yet another aspect of the current invention, the method further includes the steps of providing a wiring harness having at least one connector cavity, and at least one latch arm, and at least one flange, the flange having a bottom surface and a top surface, and inserting the dummy plug into the unused connector cavity so that the female end is substantially flush with the at least one latch arm and the base of the female end is held in place by the bottom surface of the at least one flange.

In accordance with still another aspect of the present invention, the method further includes placing a spacer on the at least one latch beam, next placing a perimeter seal on the at least one latch beam so that the perimeter seal is substantially flush with the at least one latch arm, and finally placing a pogo pin on the at least one latch arm to verify whether or not the at least one connector cavity is being used.

One advantage of the present invention is that the dummy plug is resistant to pressure blowouts, thereby making the invention functional in the market place.

Another advantage of the present invention is that the dummy plug is flush with the face of the connector, so that a pogo pin can detect whether or not the connector cavity is in use.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings, which form a part hereof and wherein.

DESCRIPTION OF AN EMBODIMENT

Figure 1:
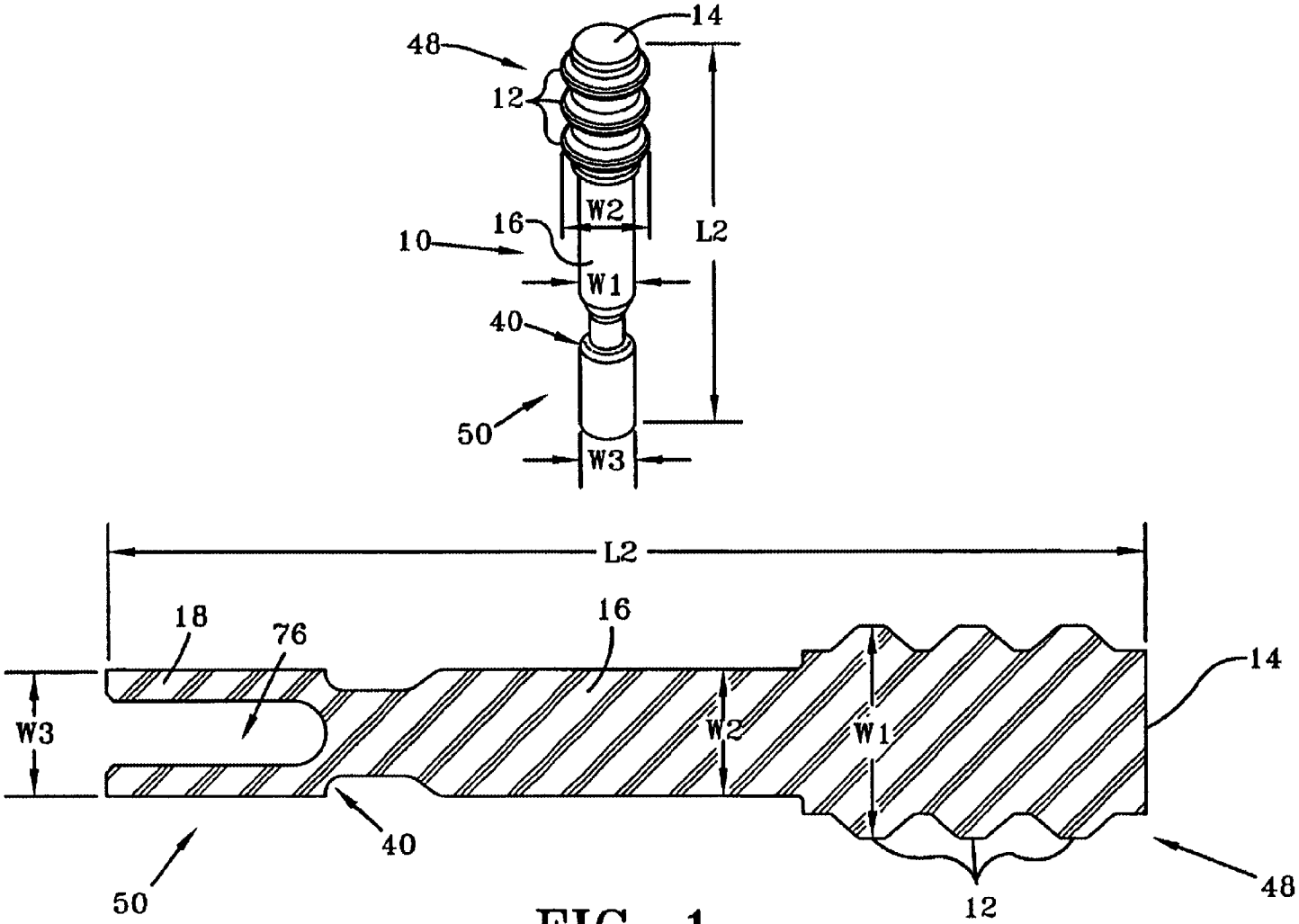
FIG. 1 is a perspective view of a dummy plug showing the head, the multiple ribs, the stem, the base, the female end, and the various widths of the dummy plug.

With respect to FIG. 1, an inventive dummy plug 10 is shown including a first end 48, a head 14, multiple ribs 12, a stem 16, a second end 50, a female end 18 with a base 40, a first width $W_1$, a second width $W_2$, a third width $W_3$, and a second length $L_2$. The female end 18 has an opening 76 for receiving male pins (not shown). The female dummy plug 10 can replace either male or female connectors (not shown). The first end 48, in this embodiment includes the head 14 and the multiple ribs 12. The second end 50 includes the female end 18 and the base 40. It is to be understood that the first and second ends 48, 50 can be of any shape or design as long as chosen using sound engineering judgment. In this embodiment, the dummy plug 10 is preferably made of 18 durometer, inherently lubricating silicon. The term "durometer" is a unit of hardness measurement. The dummy plug 10 can be made of harder material as well, and any other material chosen using sound engineering judgment.

Figure 2:
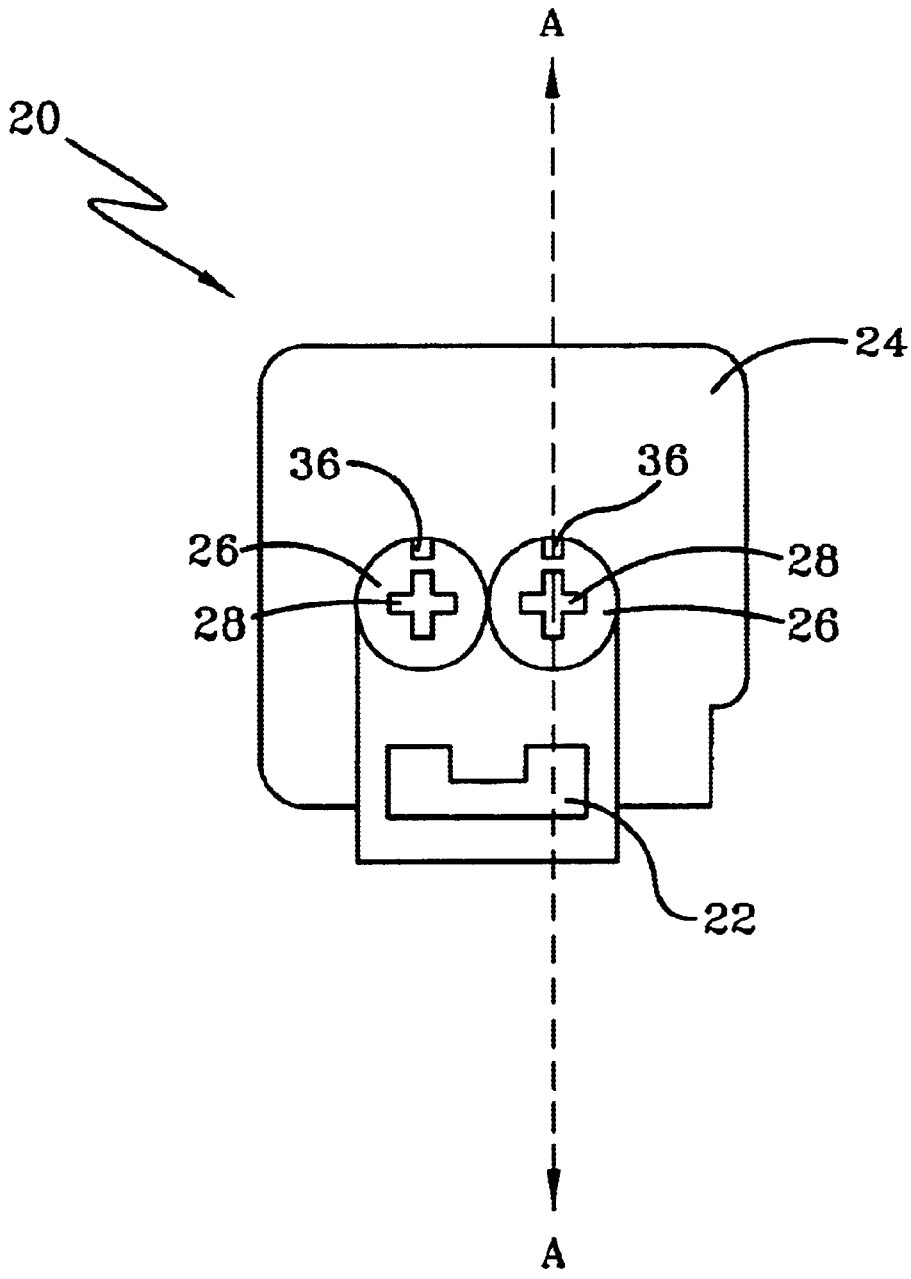
FIG. 2 is a top view of a wiring harness showing the connector body, the connector, the connector cavity, the latch arms, the clip, the flanges, and the cross-sectional line A—A.
Figure 3:
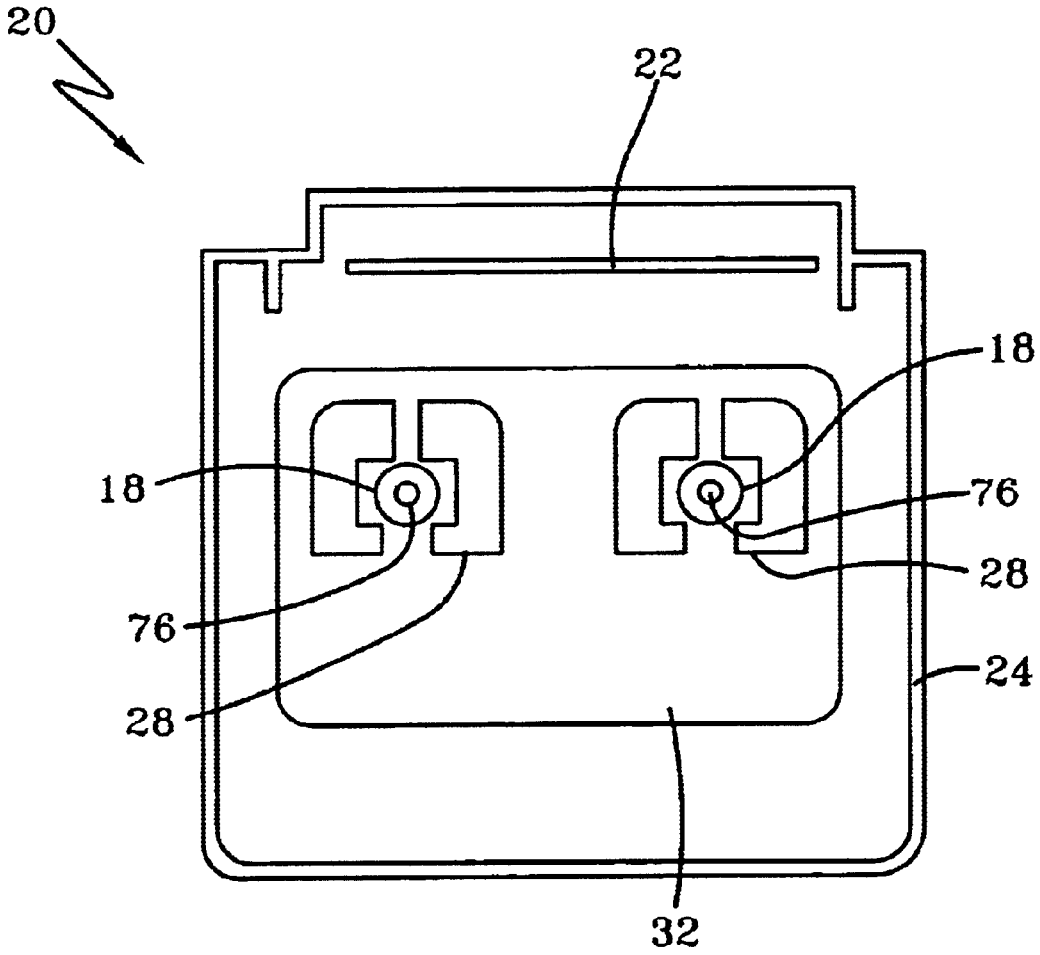
FIG. 3 is a bottom view of the connector body as shown in FIG. 2.
Figure 4:
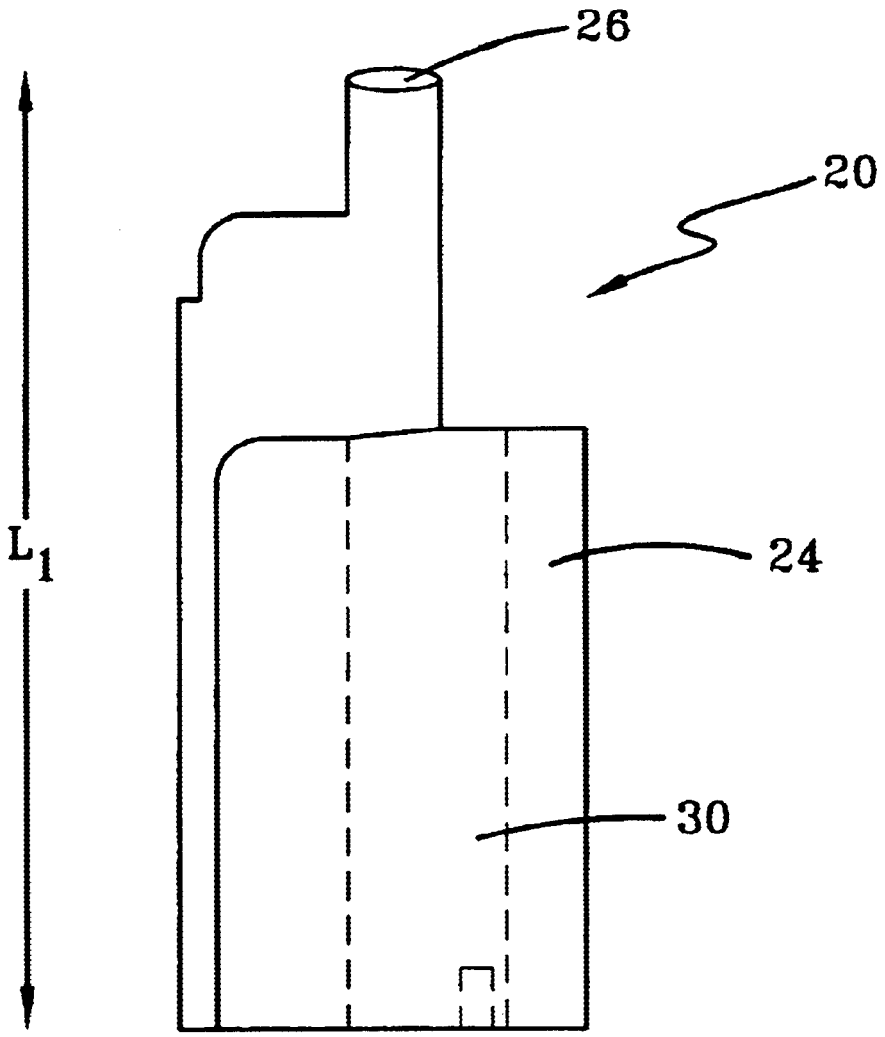
FIG. 4 is a perspective view of the connector body as shown in FIGS. 2 and 3, showing the latch beam and the first length.

The dummy plug 10 is for use with a wiring harness 20 as shown in FIG. 2. The dummy plug 10 is designed to electrically isolate unused connector cavities 26, to prevent short circuits due to wiring harness 20 movement. The wiring harness 20, as shown in FIGS. 2 and 3, includes a clip 22 for holding the wiring harness 20 in place, a connector body 24, connector cavities 26, latch arms 28, flanges 36, and a perimeter seal 32. The connector cavities 26 are for receiving wires (not shown) and can be of any number, but in the preferred embodiment there are two connector cavities 26. The number of connector cavities 26 does not always match the number of wires (not shown) used, therefore creating the need for the dummy plug 10.

Figure 5:
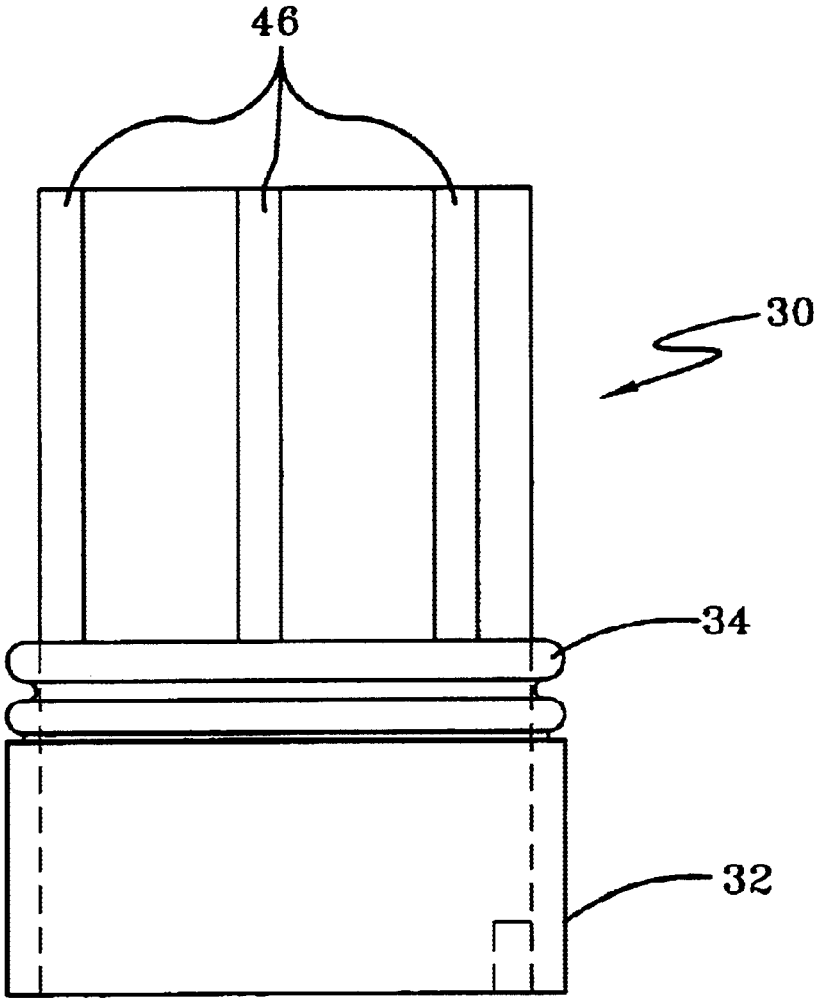
FIG. 5 is a perspective view of the latch beam, showing the spacer, and the perimeter seal.
Figure 6:
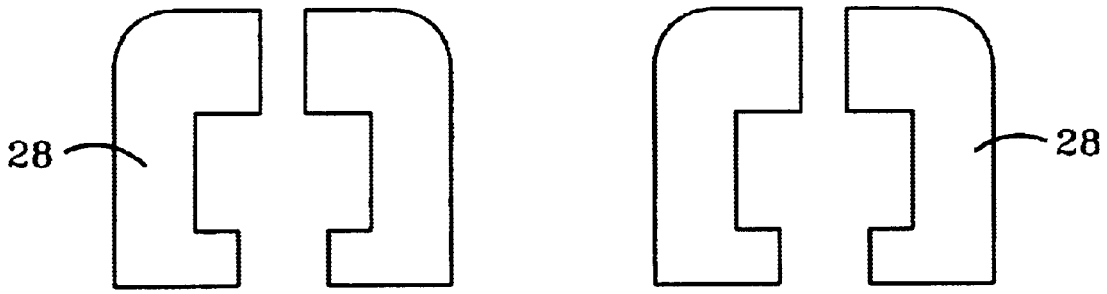
FIG. 6 is a top view of the latch arms.

With reference now to FIGS. 4–6 and 11, the wiring harness 20 encases a latch beam 30 and latch arms 28, as shown in FIG. 6. The latch beam 30 extends downwardly from the connector cavity 26 and terminates in latch arms 28. FIG. 5 shows the latch beam 30 with a spacer 34 and the perimeter seal 32 attached thereto. The spacer 34 is positioned on the latch beam 30 until the spacer 34 contacts ridges 46. The spacer 34 holds the perimeter seal 32 in place, and helps terminal retention of the latch arms 28. The perimeter seal 32 is snapped into place on the latch beam 30. Preferably, the spacer 34 is made of a silicon material, but any material can be used as long as chosen using sound engineering judgment.

Figure 9:
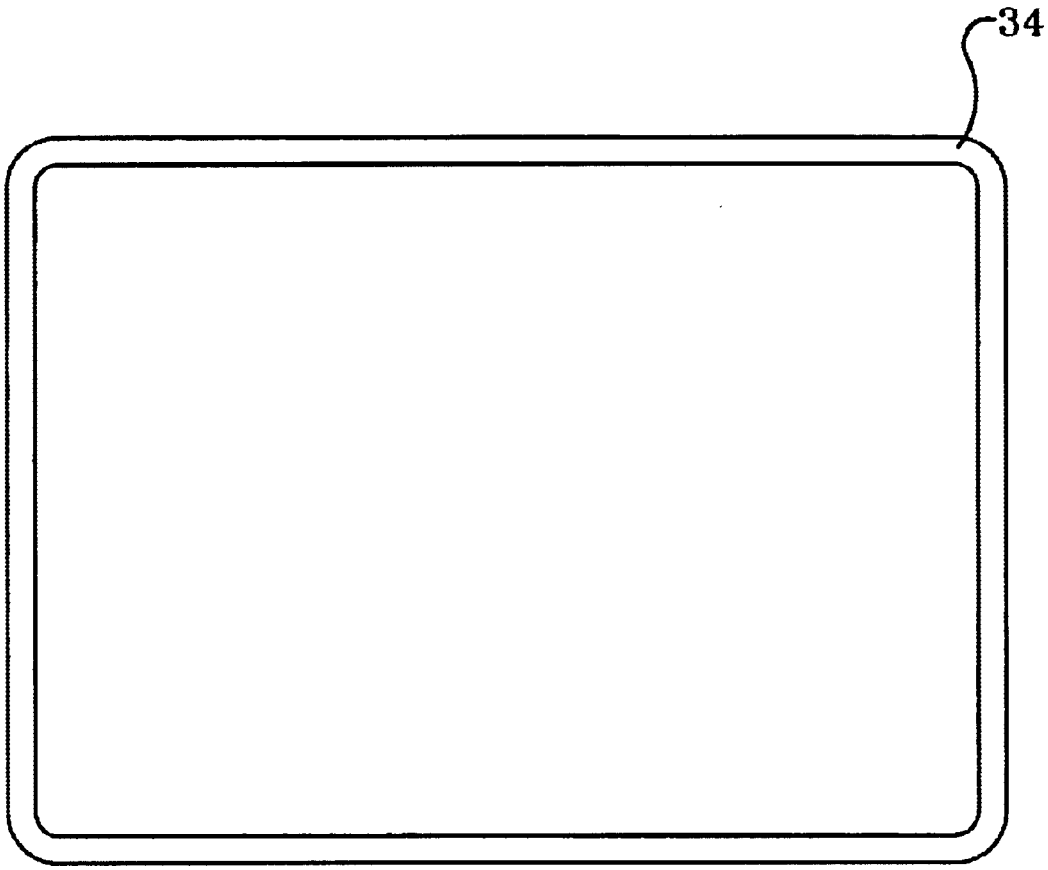
FIG. 9 is a top view of the spacer.
Figure 10:
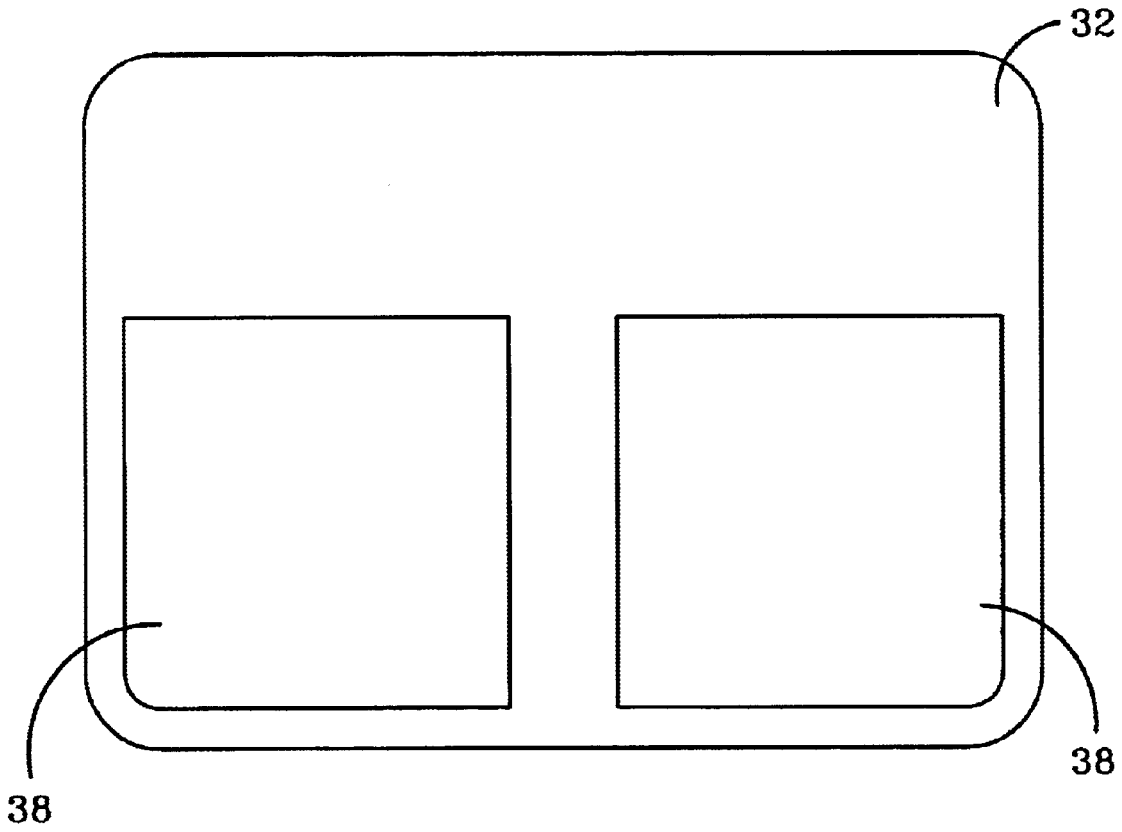
FIG. 10 is a top view of the perimeter seal, showing the latch arm openings.
Figure 11:
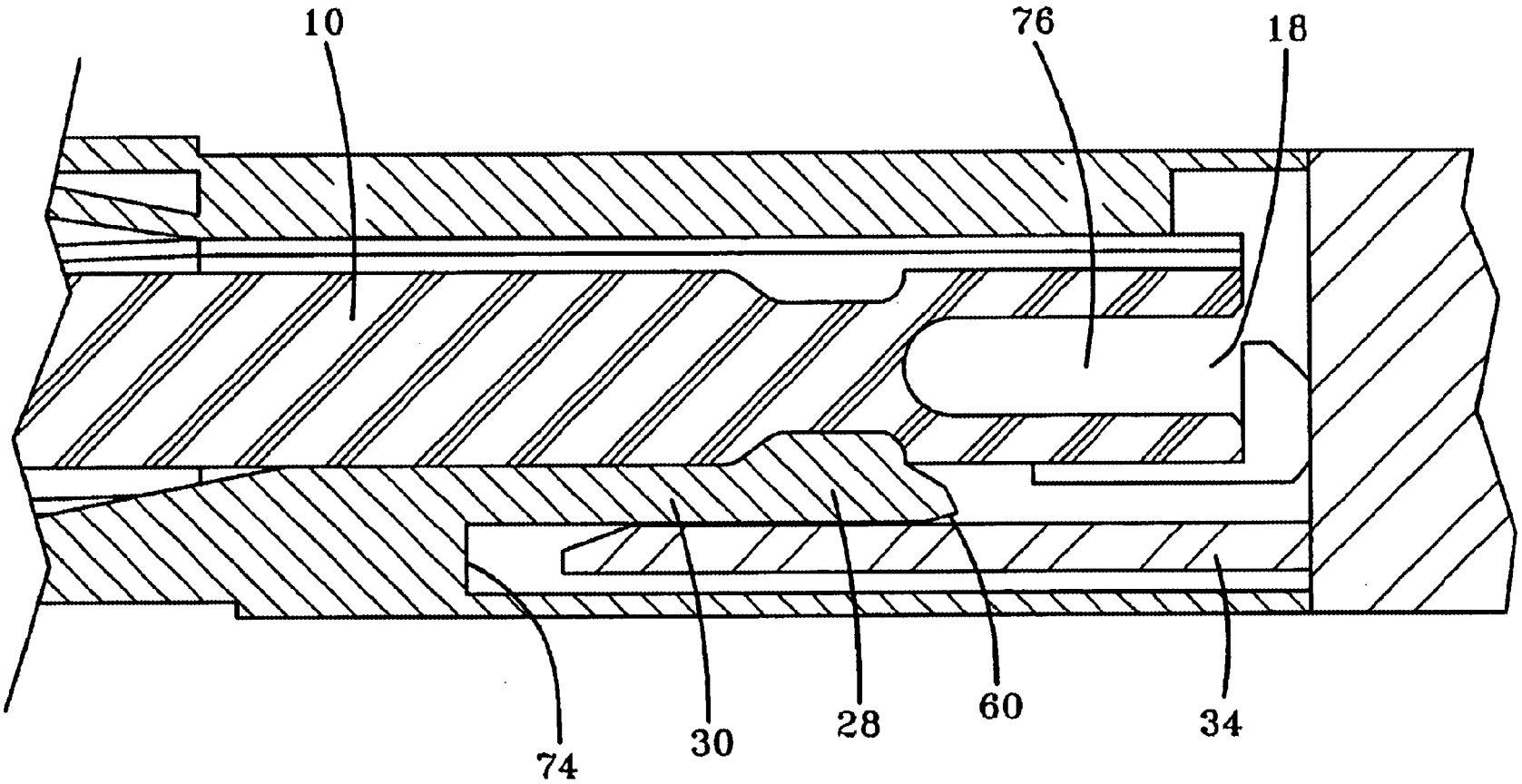
FIG. 11 is a side, cross-sectional view of a typical spacer illustrating how the spacer helps retain the terminal; and, FIG. 12 is a side, cross-sectional view of a typical pogo pin.

The spacer 34 and the perimeter seal 32 are shown in detail in FIGS. 9, 10, and 11. The spacer 34 is a rectangular shape in order to fit properly on the latch beam 30, but can be any design chosen using sound engineering judgment. The perimeter seal 32 has, in the preferred embodiment, two latch arm openings 38 in order to allow the latch arms 28 to be exposed.

With particular reference to FIG. 11, the operation of the embodiment illustrated will be explained. The spacer 34 comes in and bottoms out against surface 74. The spacer 34 keeps the latch beam 30 from being deflected by the dummy plug 10. The latch arm 28 wedges against the dummy plug 10. In order to do maintenance work, a technician removes the spacer 34 and, with a screwdriver or similar tool, deflects the latch arm 28 outwardly away from the dummy plug 10. This is accomplished by inserting the tip of the screwdriver (not shown) under the lip 60 of the latch arm 28.

Figure 7:
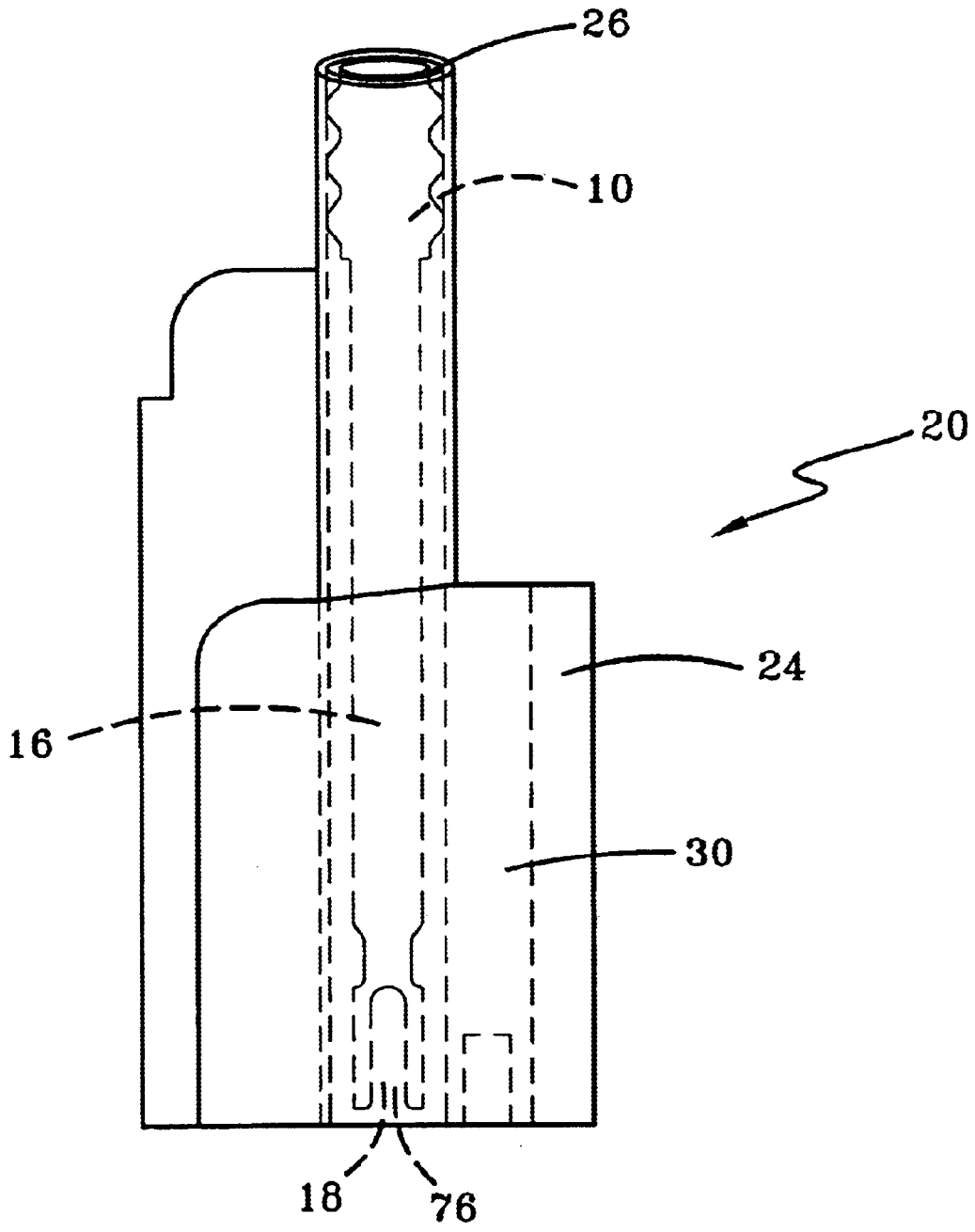
FIG. 7 is a perspective view of the connector body, showing the dummy plug in place in the connector cavity.
Figure 8:
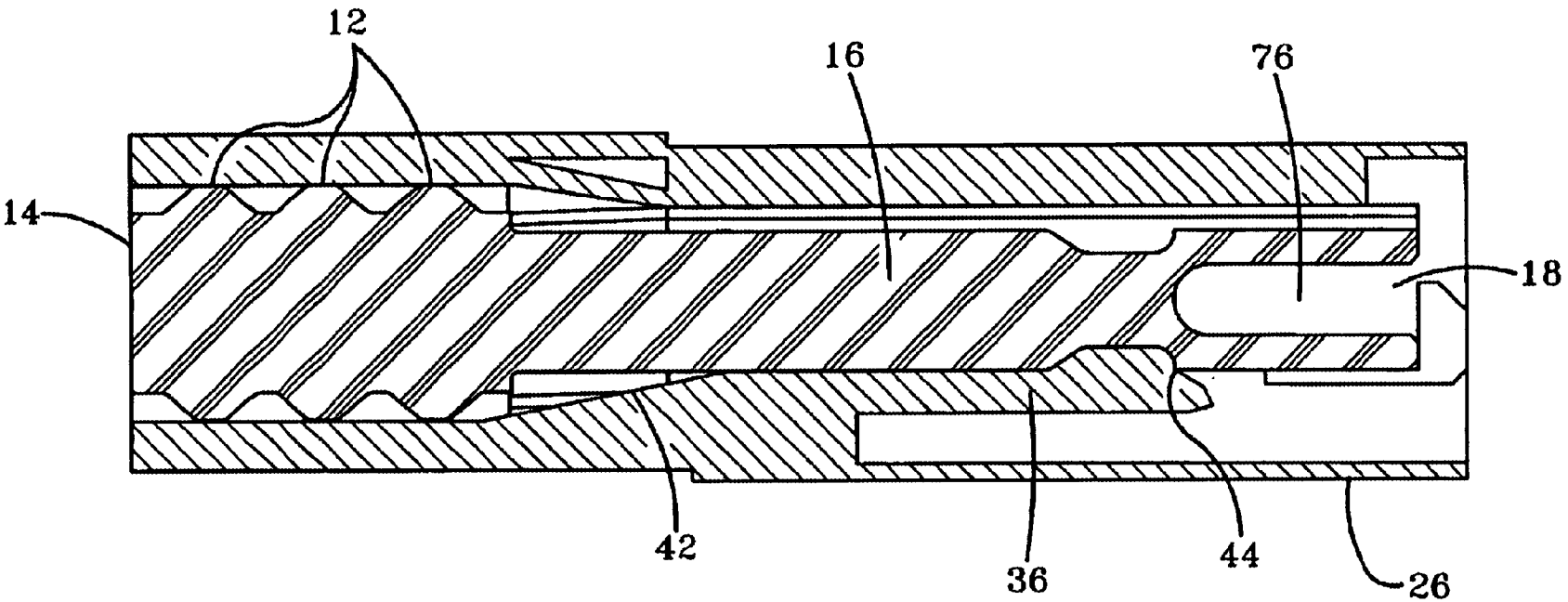
FIG. 8 is a cross-sectional view of the connector cavity, taken along line A—A of FIG. 2, showing the dummy plug being held in place by the flange.

In reference now to FIGS. 7 and 8, the dummy plug 10 is shown in place in the wiring harness 20. The dummy plug 10 fits securely in the connector cavity 26, and is held in place by the flange 36. The flange 36 has a top surface 42 and a bottom surface 44. The bottom surface 44 holds the dummy plug 10 in place by contacting the base 40 of the female end 18 of the dummy plug 10 as shown in FIG. 8. The flange 36 holding the dummy plug 10 in place helps prevents the known problem of pressure blowout.

With reference now to FIGS. 1, 3, 7, and 8, the operation of the invention will now be described. The dummy plug 10, which in this embodiment is made of inherently lubricating silicon, is inserted into the connector cavity 26. The dummy plug 10 is inserted all the way into the connector cavity 26 until becoming substantially flush with the latch arm 28. The inherently lubricating nature of the silicon allows the dummy plug 10 to be inserted into the connector cavity 26 without the need for further lubrication. The configuration of the dummy plug 10 allows for a secure fit of the dummy plug 10 within the connector cavity 26. The multiple ribs 12 aid in securing the dummy plug 10 in place and preventing pressure blowout. The multiple ribs 12 of the dummy plug 10 have a first width $W_1$, the stem 16 has a second width $W_2$, and the female end 18 has a third with $W_3$. The first width $W_1$ is greater than the third width $W_3$ which is greater than the second width $W_2$ ($W_1>W_3>W_2$). This narrowing, than expansion, of the dummy plug 10 allows for easy insertion of the dummy plug 10 into the connector cavity 26 while still allowing the flange 36 to hold the dummy plug 10 in place. The aforementioned widths $W_1$, $W_2$, $W_3$ are simply embodiments of the invention are not intended to limit the invention in any way. The dummy plug 10 can have any widths as long as chosen using sound engineering judgment.

The dummy plug 10 also has a second length $L_2$ to correspond with a first length $L_1$ of the wiring harness 20. The second length $L_2$ and the first length $L_1$ are substantially similar, allowing the female end 18 of the dummy plug 10 to be substantially flush with the latch arm 28 of the wiring harness 20. The two lengths $L_1$ and $L_2$ being substantially similar allows the head 14 of the dummy plug 10 to be flush with the top (shown, but not referenced) of the connector cavity 26 as well as the female end 18 being flush with the latch arm 28. Once the dummy plug 10 is in place in the connector cavity 26, a pogo pin 62 (See FIG. 12) can be used to detect if the connector cavity 26 is in use or not in use. The pogo pin (See FIG. 12) can only be effective for this determination if the female end 18 of the dummy plug 10 is substantially flush with the latch arm 28.

Figure 12:
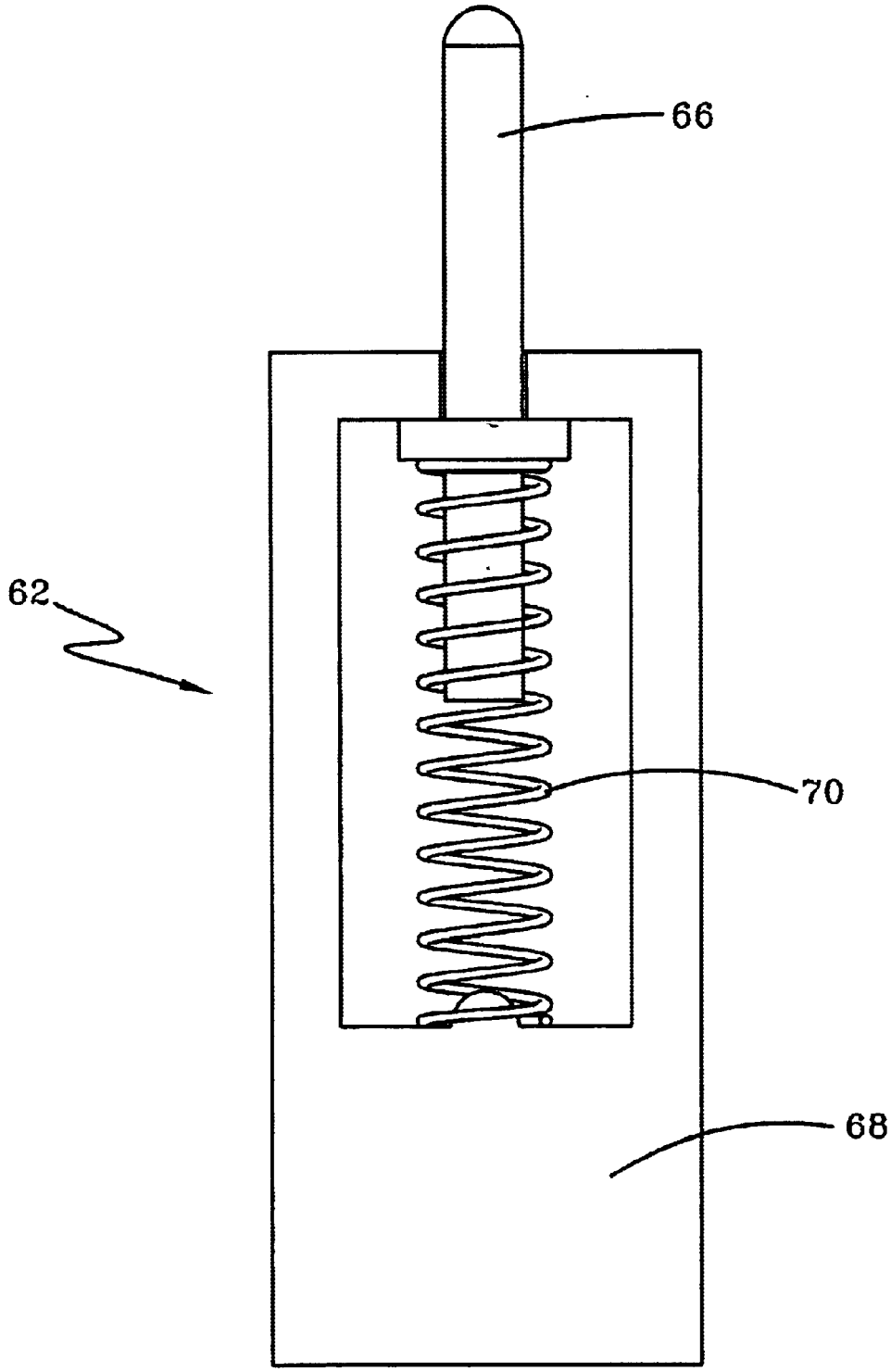

With reference to FIG. 12, a typical pogo pin 62 is illustrated. The shaft 66 rides within the collar 68 and is acted upon by spring 70.

The invention has been described with reference to preferred embodiments. Obviously, modifications and alterations will occur to others upon a reading and understanding of this specification. It is intended to include all such modifications and alternations in so far as they come within the scope of the appended claims or the equivalents thereof.

I claim:

1. A dummy plug for use with an associated wiring harness, the wiring harness having connector body, two connector cavities, a flange for securing the dummy plug in place, flange having a top surface and a bottom surface, a latch beam, two latch arms, a first length a spacer, and a perimeter seal, the perimeter seal having two latch arm openings for receiving latch arms, the dummy plug comprising:

18 durometer inherently lubricating silicon;

a head;

multiple ribs, the multiple ribs having a first width;

a stem, the stem having a second width, the second width being less than the first width;

a female end, the female end having a third width, the third width being less than the first width and greater than the second width, the female end having a base, the base being held in place by the associated bottom surface; and, a second length, the second length being substantially the same as the associated first length, such that the female end is substantially flush with the associated latch arm.

2. A dummy plug for use with an associated wiring harness, the wiring harness having a first length, a latch beam, and a latch arm, the dummy plug comprising:

a first end;

a female end;

a second length, the second length being substantially the same as the associated first length;

ahead:

a stem, the stem having a second width, the female end having a third width, the third width being greater than the second width; and, a base, the base being held in place by the associated bottom surface.

3. The dummy plug of claim 2, wherein the dummy plug has multiple ribs.

4. The dummy plug of claim 3, wherein the dummy ping is inherently lubricating silicon.

5. The dummy plug of claim 4, wherein the silicon is 18 durometer.

* * * * *

UNITED STATES PATENT AND TRADEMARK OFFICE

CERTIFICATE OF CORRECTION

PATENT NO. : 6,808,418 B2
DATED : October 26, 2004
INVENTOR(S) : Patrick L. Horner It is certified that error appears in the above-identified patent and that said Letters Patent is hereby corrected as shown below:

Column 6,
Line 23, insert -- a -- after “having”
Line 25, insert -- the -- after “place,”
Line 26, delete “length” and insert -- length, --
Line 28, insert -- the -- after “receiving”
Line 51, delete “ahead:” and insert -- a head: --

Signed and Sealed this

First Day of February, 2005

JON W. DUDAS
*Director of the United States Patent and Trademark Office*